US007311390B2

(12) United States Patent
Huang

(10) Patent No.: US 7,311,390 B2
(45) Date of Patent: Dec. 25, 2007

(54) DEVICE AND METHOD FOR PRINT HEAD MAINTENANCE

(75) Inventor: Shr-How Huang, Taipei (TW)

(73) Assignee: BENQ Corporation, Taoyuan (TW)

( * ) Notice: Subject to any disclaimer, the term of this patent is extended or adjusted under 35 U.S.C. 154(b) by 356 days.

(21) Appl. No.: 11/041,206

(22) Filed: Jan. 25, 2005

(65) Prior Publication Data

US 2005/0174405 A1 Aug. 11, 2005

(30) Foreign Application Priority Data

Feb. 11, 2004 (TW) ..... 93103151 A

(51) Int. Cl.
*B41J 2/185* (2006.01)
*B41J 2/165* (2006.01)

(52) U.S. Cl. ..... 347/90; 347/33

(58) Field of Classification Search ..... 347/29, 347/31, 32, 33, 36, 90, 91
See application file for complete search history.

(56) References Cited

U.S. PATENT DOCUMENTS 5,563,639 A * 10/1996 Cameron et al. ..... 347/34
5,757,395 A 5/1998 Chew et al.
5,774,142 A 6/1998 Nguyen et al.
6,076,913 A * 6/2000 Garcia et al. ..... 347/19
6,102,518 A * 8/2000 Taylor ..... 347/29
6,168,258 B1 * 1/2001 Lou et al. ..... 347/33
6,533,377 B2 * 3/2003 Su et al. ..... 347/1
6,846,063 B2 * 1/2005 Spitz et al. ..... 347/36

FOREIGN PATENT DOCUMENTS

EP 0 744 300 A2 11/1996

* cited by examiner

*Primary Examiner*—Anh T. N. Vo
(74) *Attorney, Agent, or Firm*—Birch, Stewart, Kolasch & Birch, LLP

(57) ABSTRACT

A print head maintenance device. During maintenance, excess ink dispersed from the print head is collected in a collection device. A shuttle moves with the print head in a first direction, with a wiper moves in a second direction wiping remaining ink from the print head. The shuttle returns to an initial position at which time ink collected in the collection device is drained out and absorbed by an absorber.

10 Claims, 5 Drawing Sheets

DEVICE AND METHOD FOR PRINT HEAD MAINTENANCE

BACKGROUND OF THE INVENTION

1. Field of the Invention

The present invention relates to a maintenance device for a print head, and in particular to a maintenance device provided with a collection device having a special configuration.

2. Brief Description of the Related Art

A conventional maintenance device for a print head of an office machine (e.g. printer) comprises a wiper wiping ink remaining on the print head, a cap covering the print head to prevent dried ink from jamming the printing nozzle, a scraper scraping remaining ink from the wiper, a collection device collecting ink sprayed from the print head and an absorber absorbing the ink from the collection device.

A conventional collection device for ink as disclosed in U.S. Pat. No. 5,563,639 is placed at the bottom of a maintenance device as a reservoir collecting the sprayed ink. However, in such structure, excess ink easily sprays onto the print media.

Another conventional collection device as disclosed in U.S. Pat. No. 5,774,142 discloses two collecting containers to collect sprayed ink, referred to as primary and secondary spittoons. An opening and a rib are defined at ⅔ the height of the primary spittoon. The ink collected in the primary spittoon may overflow into the secondary spittoon. However, in such structure, the ink can easily escape containment and sully the printer.

The absorber is a sponge disposed on the bottom of the printer. Sprayed ink is routed to the absorber by a pump or impelled thereto via the opening. When diffusion rate is less than ink accumulation rate on the sponge, a saturation area on the sponge can allow the ink to easily escape.

SUMMARY OF THE INVENTION

Accordingly, an object of an embodiment of the invention is to provide a maintenance device for a print head which guides accumulated ink via an inclined structure to an absorber when the print head moves. Ink dispersion thus exceeds the ink accumulation rate, avoiding ink escaping into the maintenance device.

A collection device of the invention comprises a first incline having a first upper end and a first lower end, a second incline having a second upper end, a second lower end and two sides adjacent to the first lower end, a plane adjacent to the second lower end, and a third incline having a third upper end adjacent to the plane. Ink sprayed by the print head is collected on the plane via the first and the second inclines and drained out of the collection device via the third incline.

The collection device further comprises a first rib structure, a second rib structure and a third rib structure. The first rib structure is disposed on the first incline and extends from the first upper end to the first lower end to prevent the ink spraying; the second rib structure is disposed on the second incline and extends from the first upper end to the first lower end to prevent ink spraying; the second rib structure is disposed on the second incline and extends from the second upper end to the second lower end; the third rib structure surrounds a part of the collection device to prevent ink drops escaping from the collection device.

A print head maintenance device of the invention comprises a chassis, a shuttle mounted on the chassis sliding between an initial position and a terminal position, a collection device disposed on the shuttle, a wiper slidably disposed on the shuttle, an absorber disposed on the chassis and contacting the collection device in the initial position and a latching element disposed on the chassis, wherein when the shuttle slides in a first direction toward the terminal position, the wiper moves in a second direction oblique to the first direction.

A print head maintenance method comprises the following steps: providing a maintenance device including a collection device, a shuttle bearing the collection device, a wiper sliding on the shuttle and an absorber; collecting excess ink in the collection device; moving the shuttle in a first direction from a initial position to a terminal position to move the wiper in a second direction so as to wipe remaining ink from the print head; and accumulating ink drained from the collection device by an absorber when the shuttle returns to the initial position.

The rib structure of the invention guides the spreading ink along the incline structure to prevent escaping to the paper or printer. The ink is guided downward to the absorber when the print head moves back and forth such that ink diffusion rate in the absorber exceeds ink accumulation rate, preventing saturation and subsequent leakage.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the subsequent detailed description and the accompanying drawings, which are given by way of illustration only, and thus are not limitative of the present application, and wherein.

DETAILED DESCRIPTION OF THE PREFERRED EMBODIMENTS

Figure 1:
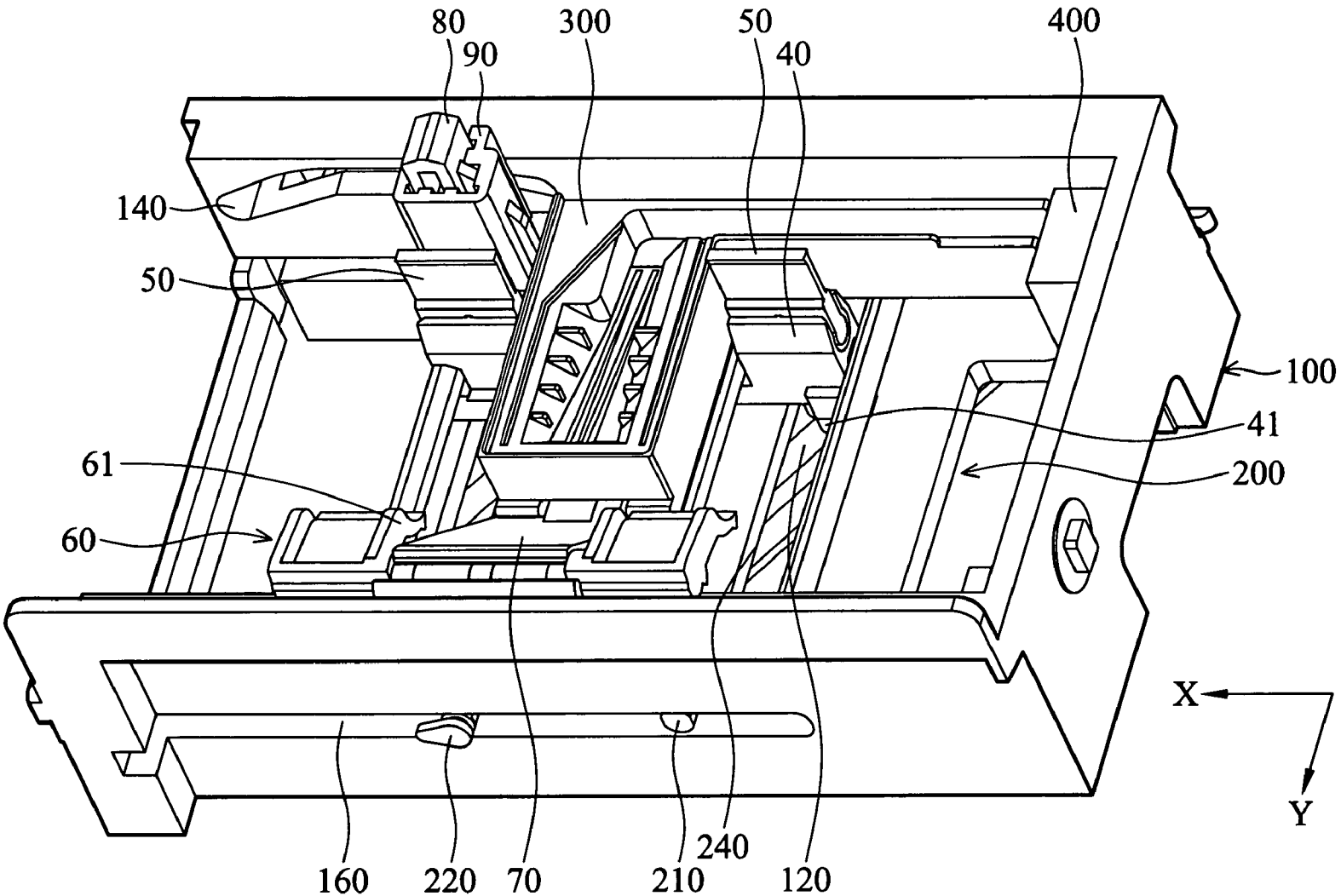
FIG. 1 is a perspective view of a print head maintenance device of an embodiment of the invention.
Figure 2:
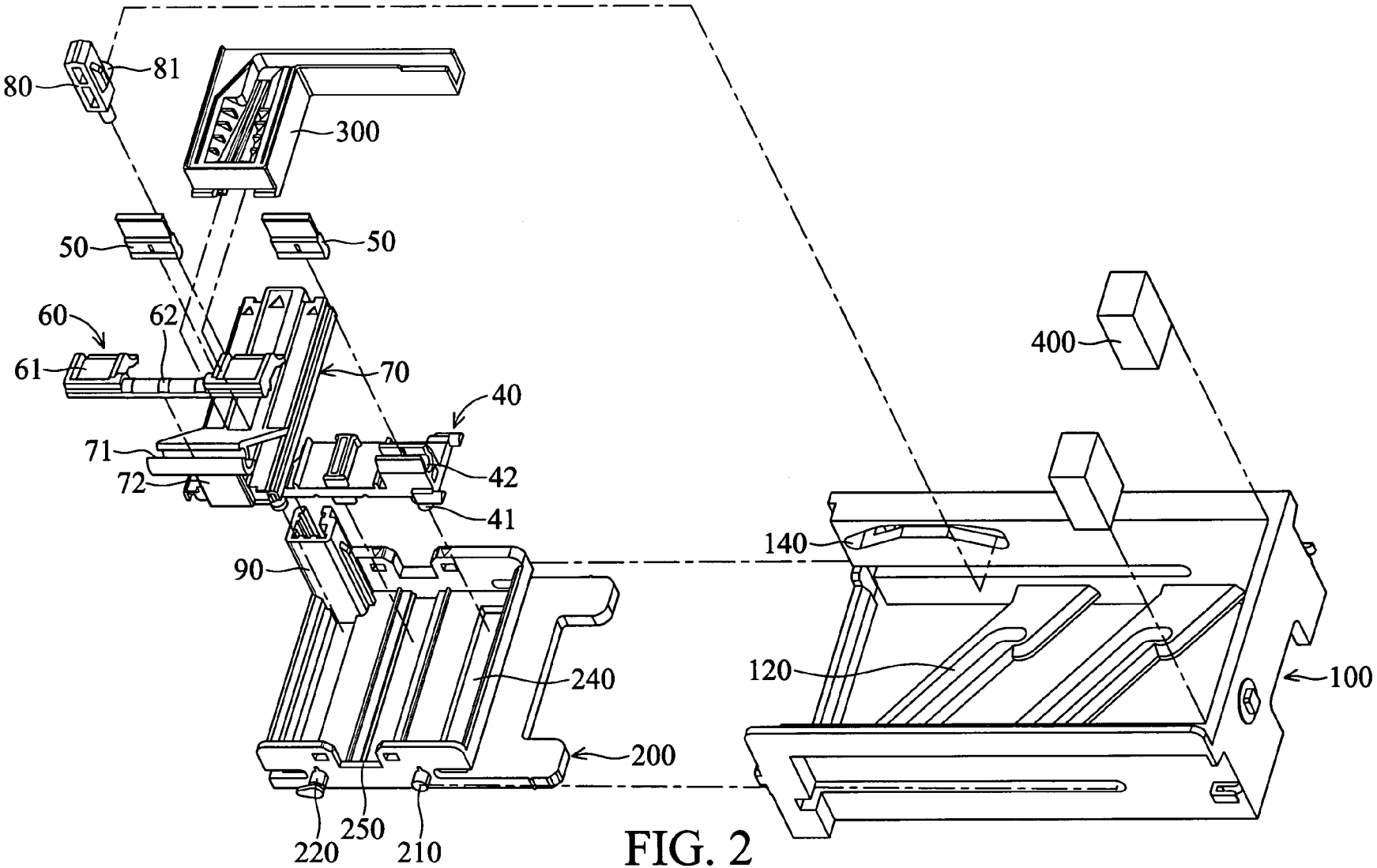
FIG. 2 is an exploded perspective view of a print head maintenance device of an embodiment of the invention.

FIG. 1 is a perspective view of the print head maintenance device. FIG. 2 is an exploded perspective view of the print head maintenance device. As shown in FIGS. 1, 2, the maintenance device of the invention comprises a chassis 100, a shuttle 200, a collection device 300, an absorber 400, a wiper 50 and a scraper 60.

As shown in FIG. 2, a first seat 40 slides on the shuttle 200 by a protrusion 41 inserted in a first slot 240. A second seat 70 above the first seat 40 is mounted on the shuttle 200 by a key 72 engaging a notch 250 thereof. The collection device 300 is mounted on the second seat 70, slidable on the maintenance device along with the shuttle 200.

A shaft 20 of the scraper 60 inserted into a channel 71 of the second seat 70 rotates therein. The wiper 50 vertically inserted in a channel 42 of the first seat 40 is fixed therein. A latching element 80 inserted into a seat 90 integrally formed with the shuttle 200 is capable of moving up and down therein.

When the shuttle 200 slides on the chassis 100 by lugs 210, 220 inserted in the slot 160, the protrusion 41 of the first seat 40 and a protrusion 81 of the latching element 80 are inserted respectively into a second slot 120 and a third slot 140. The absorber 400 is disposed on a corner of the chassis 100 and contacts the ink output of the collection device 300.

Figure 3:
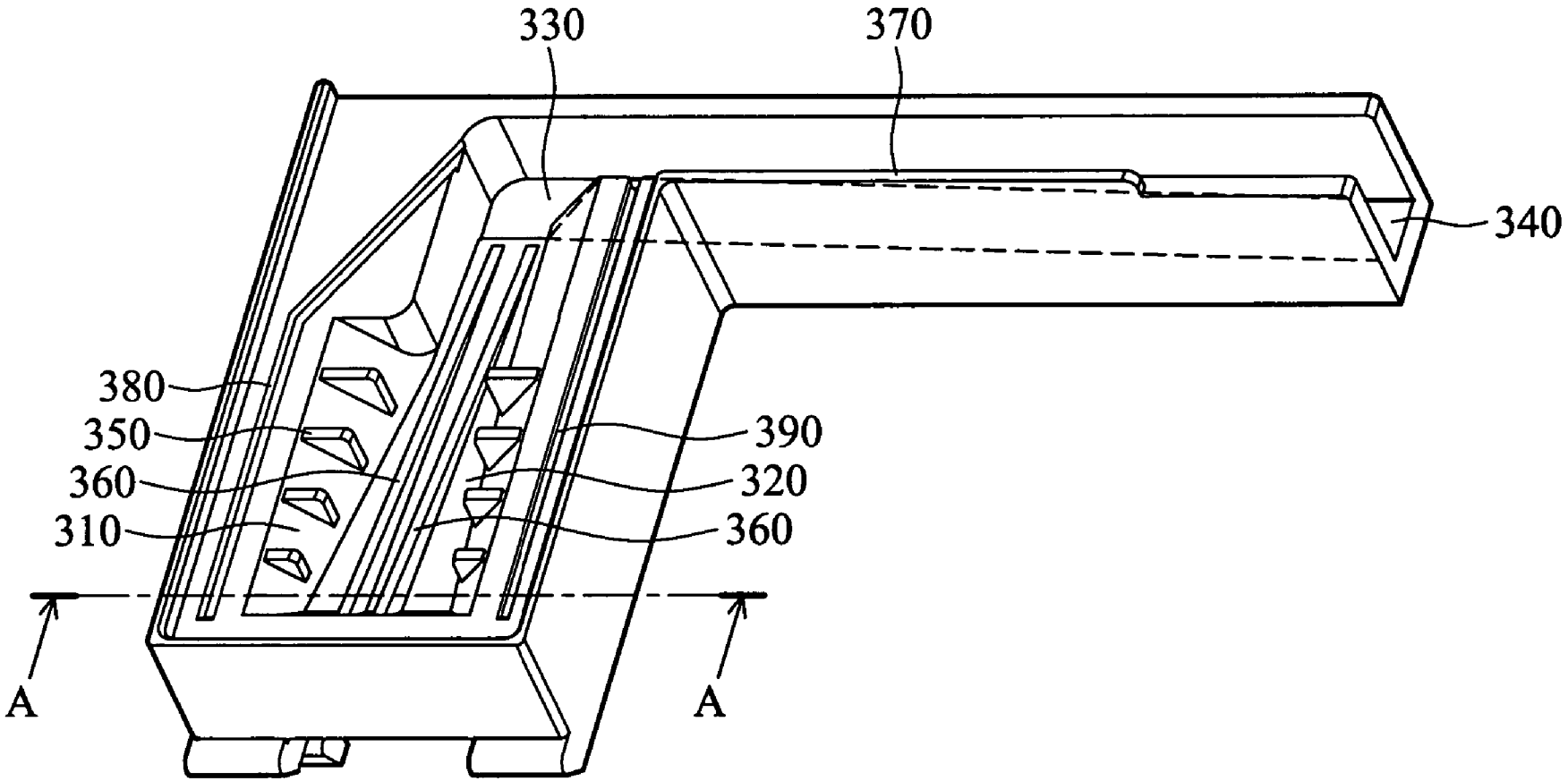
FIG. 3 is a top view of the collection device of an embodiment of the invention.

FIG. 3 is a top view of the collection device 300, wherein excess ink flows along a first incline 310 and a second incline 320 adjacent to the lower end of the first incline 310, and collected in the plane 330 adjacent to the lower end of the second incline 320. The ink in the plane 330 flows through a third incline 340 and drains out of the collection device 300 to be absorbed by the absorber 400 by the movement of the collection device 300 and the inertia of the ink flow. A first rib structure 350 and a second rib structure 360 are respectively disposed on the first incline 310 and the second incline 320 to guide the ink flow.

The first rib structure 350, including several parallel ribs disposed on the first incline 310 arrests flow of ink to the printer or printing paper, and the second rib structure 360, including several parallel ribs disposed on the second incline 320 arrests flow of ink while accepting ink according to color (e.g. cyan, yellow and magenta or light yellow, light cyan and black) via different nozzle output.

The collection device further has a third rib 370 surrounding a part of the collection device 300 to avoid overflow of the ink. Moreover, grooves 380, 390 defined on the top of the first incline 310 receive and guide already sprayed ink drops back into the plane 330 and the third incline 340.

Figure 4:
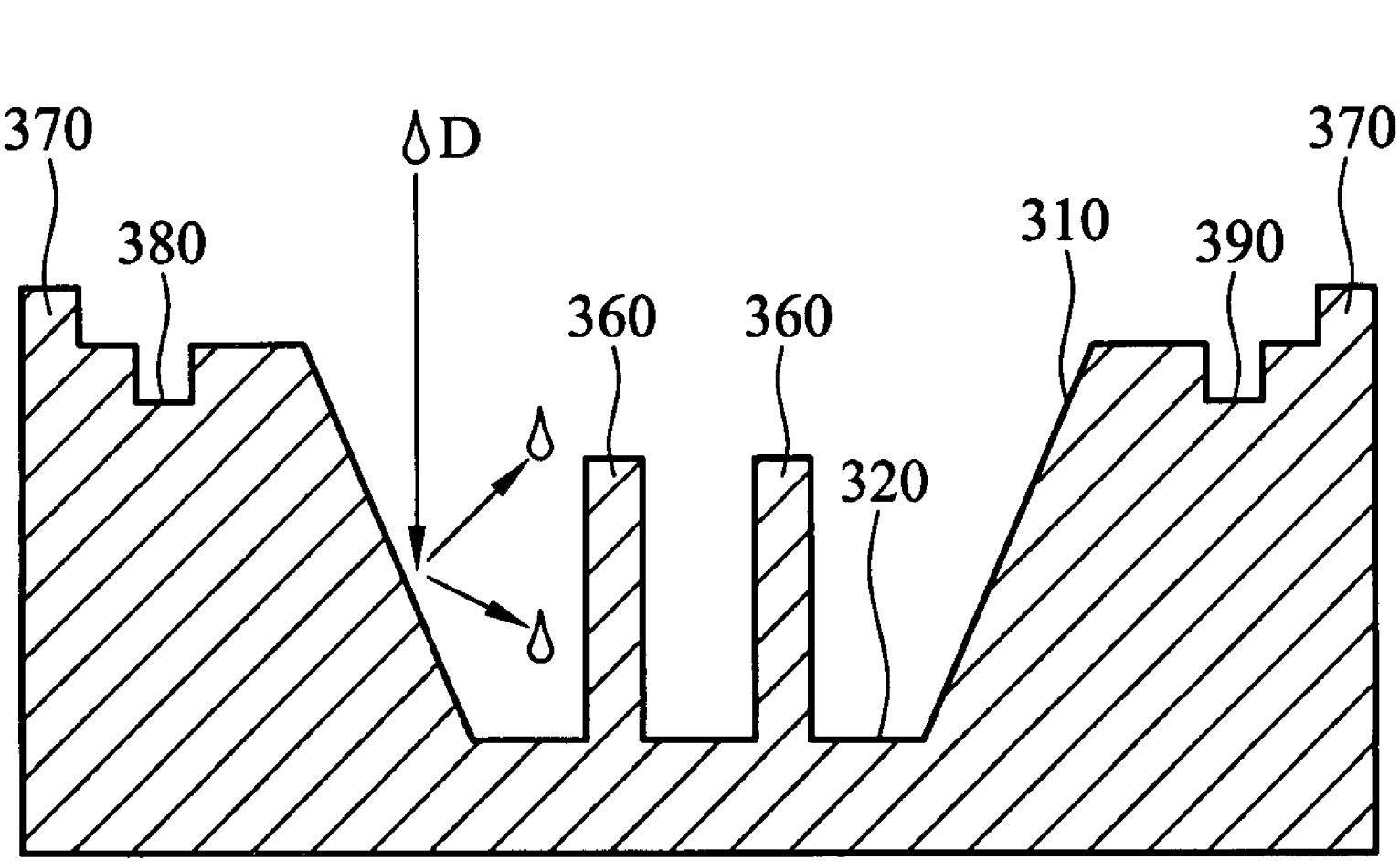
FIG. 4 is a cross section along the line A-A of FIG. 3.

FIG. 4 is a cross section of the collection device 300 along the line A-A of FIG. 3. FIG. 4 shows the second rib structure 360 arresting ink spray. When ink drops D fall onto the first incline 320, the second rib structure 360 effectively stops excess ink spray.

Figure 5:
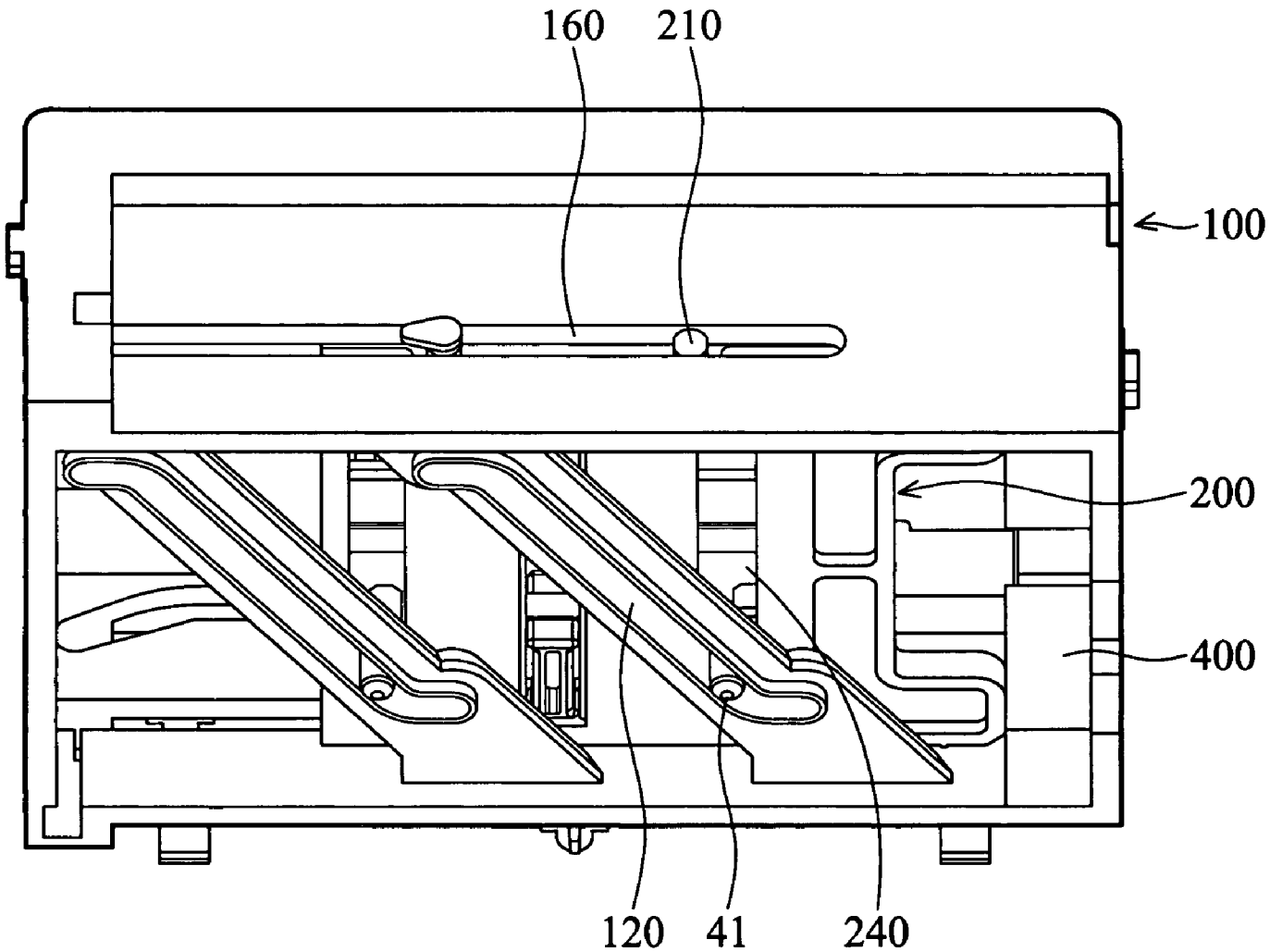
FIG. 5 is another perspective view of the print head maintenance device of an embodiment of the invention.

Referring to FIG. 1 again, the shuttle 200 and the collection device 300 are in an initial position. When maintenance begins, the print head (not shown) moves to the collection device 300 for ink discharge. Ink received in the collection device 300 flows along the second incline 320 to the plane 330, and then the print head engages the latching element 80, conveying the shuttle 200 and collection device 300. As the protrusion 41 of the first seat 40 enters the first slot 240 and the second slot 120 at the same time (as shown in FIG. 5), the wiper 50 moves in direction y with respect to the shuttle 200 to wipe remaining ink from the print head, thus oblique to x direction because the wiper 50 moves along with the shuttle 200. The wiper 50 continues to move to the scraper 61 to scrape the ink remaining on the wiper 50. At this time, the ink in the collection device 300 is retained on the second incline 320 and the plane 330.

When the print head moves to a terminal position, the contour of the third slot 140 moves the latching element 80 downward to withdraw from the print head (the protrusion 81 of the latching element 80 inserted in the third slot 140 moves the latching element 80 up and down in the seat 90). A spring (not shown) on the shuttle 200 returns shuttle 200 and the collection device 300 to the initial position. The ink on the plane 330 flows along the third incline 340 to the absorber 400.

The rib structures of the invention may guide the spreading ink to flow along the incline structure to prevent its escape to the paper or printer. The ink is guided downward to the absorber when the print head moves, with diffusion rate more than the ink accumulation rate to prevent pollution to the print head maintenance device.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A print head maintenance device, comprising:

a chassis;

a shuttle mounted on the chassis moving between an initial position and a terminal position;

a collection device disposed on the shuttle;

a wiper slidably disposed on the shuttle;

an absorber disposed on the chassis contacting the collection device in the initial position; and a latching element disposed on the chassis;

wherein when the shuttle moves in a first direction toward the terminal position, the wiper moves in a second direction oblique to the first direction.

2. The print head maintenance device as claimed in claim 1 further comprising a scraper disposed on the shuffle.

3. The print head maintenance device as claimed in claim 1, wherein the collection device comprises a first incline, a second incline having two sides adjacent to the first incline, a plane adjacent to the second incline and a third incline adjacent to the plane, wherein excess ink dispersed by the print head is collected on the plane via the first and the second inclines and drained out of the collection device via the third incline.

4. The print head maintenance device as claimed in claim 1, wherein the shuttle comprises a first slot in which the wiper slides.

5. The maintenance device for a print head as claimed in claim 4, wherein the chassis comprises a second slot for the wiper moving therein, whereby the wiper moves in the second direction by the shuttle sliding in the first direction.

6. The print head maintenance device as claimed in claim 1, wherein the chassis further has a third slot into which a protrusion of the latching element is slidably inserted.

7. The print head maintenance device as claimed in claim 6, wherein the latching element is separated from the print head when the shuttle reaches the terminal position.

8. The print head maintenance device as claimed in claim 1, wherein the collection device is formed integrally with the shuttle.

9. A print head maintenance method comprising the following steps:

providing a maintenance device comprising a collection device, a shuttle bearing the collection device, a wiper slidably disposed on the shuttle and an absorber;

collecting excess dispersed ink in the collection device;

moving the shuttle in a first direction from an initial position to a terminal position to move the wiper in a second direction to wipe remaining ink from the print head; and absorption of ink drained from the collection device by an absorber when the shuttle returns to the initial position;

wherein the first direction is oblique to the second direction.

10. The maintenance method for a print head as claimed in claim 9, wherein the maintenance device further includes a return device returning the shuttle to the initial position.

* * * * *